US005148926A

United States Patent [19]

Cocuzzo et al.

[11] Patent Number: 5,148,926

[45] Date of Patent: Sep. 22, 1992

[54] BOTTLE HOLDER

[76] Inventors: Daniel Cocuzzo, 451 Moody St., Waltham, Mass. 02154; Charles Deegan, 45 Merrimack St., Lowell, Mass. 01852

[21] Appl. No.: 806,698

[22] Filed: Dec. 12, 1991

[51] Int. Cl.[5] ..... A47F 5/00

[52] U.S. Cl. ..... 211/118; 211/74; 248/312; 248/317; D6/525

[58] Field of Search ..... 211/74, 113, 118; 248/312, 317, 328, 318; D6/525

[56] References Cited

U.S. PATENT DOCUMENTS

D. 311,679 10/1990 Morris ..... 248/318 X 3,709,373 1/1973 Aquilar ..... 211/113

4,108,314 8/1978 Raeca ..... 211/113 X 4,998,647 3/1991 Sharp ..... 211/113 X

*Primary Examiner*—Robert W. Gibson, Jr.

*Attorney, Agent, or Firm*—Iandiorio & Dingman

[57] ABSTRACT

A bottle holder is rotatably mounted about the neck of a bottle. The bottle holder includes a bottle engaging means pivotally affixed to a connector element. An attachment means is rotatably connected to the connector element. In operation, the cooperative effects of the pivoting of the bottle engaging means and rotation of the attachment means permits the holder to safely support a variety of different sized and configured bottles.

16 Claims, 2 Drawing Sheets

BOTTLE HOLDER

BACKGROUND OF THE INVENTION

1. Field of the Invention

The present invention relates to bottle holders and, more particularly, relates to an apparatus for suspending bottles in a shower so that they are conveniently positioned and their contents are easily accessible.

2. Description of the Prior Art

Several apparatuses for suspending bottled toiletries are known in the art. Exemplary devices are shown in U.S. Pat. Nos. 2,838,209, 3,024,564, and 4,108,314.

Known devices such as shower caddies, cabinet-style supports, and hanging fixtures which attach to a bottle have met with limited success. Shower caddies suffer from the disadvantage that oversized bottles often can not be safely accommodated due to the limited size of their cabinet section. Smaller bottles on the other hand are frequently to small to be used in conjunction with those support systems utilizing clamps. Further, hanging fixtures including clamping members often suffer from the disadvantage that the bottles are not freely rotatable and pivotable relative to the clamping member. Consequently, the bottles do not hang properly and, often times, they become tangled with one another.

A need has arisen for a support apparatus which does not suffer from the foregoing limitations and disadvantages.

SUMMARY OF THE INVENTION

It is an object of the present invention to provide a bottle holder which does not suffer from the foregoing disadvantages and limitations.

It is another object of the present invention to provide a bottle holding device for hanging one or more bottles in such a manner that the bottles are conveniently positioned and their contents easily accessible.

The bottle holding device of the present invention is characterized by a bottle engaging means, a connector element, and an attachment means. The holder is configured to be used with bottles having neck portions on which bottle caps can be secured and removed.

The bottle engaging means is configured to be secured to a bottle and pivotally connected to the connector element. The bottle engaging means has an open ring portion that terminates in a pair of legs. The ring portion is sized to freely fit over the neck of a bottle and be loosely secured between the shoulder of the bottle and the bottle cap.

The connector element is a cap having a depending skirt. The skirt includes a pair of oppositely disposed holes which receive the ends of the legs of the bottle engaging means. A third hole is centrally located in the closed end of the cap. A slot, which receives the attachment means during assembly of the invention, runs the length of the skirt and terminates at the hole in the closed in of the cap.

The attachment means has a ring portion which is sized to receive a cord. The attachment means which includes a head portion, neck, and foot portion is rotatably attached to the connector element. The foot of the attachment means bears against the legs of the bottle engaging means so as to hold them in the holes in the connector element.

The invention also contemplates a holder for supportingly engaging two or more bottles. One of the bottles can be inverted. This embodiment of the invention utilizes at least two holders of the type described above joined together via their attachment means. More particularly, the attachment means are connected using, for example, a cord which can then be attached to a projection extending into the shower compartment.

Other general and specific objects of the invention will in part be obvious and will in part appear hereinafter.

The invention accordingly comprises the steps and apparatus embodying features of construction, combinations of elements and arrangements of parts adapted to effect such steps, as exemplified in the following detailed disclosure, and the scope of the invention is indicated in the claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
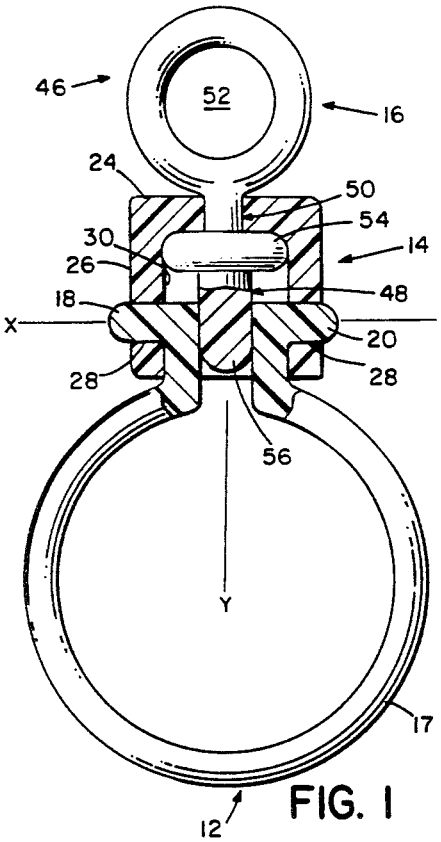
FIG. 1 is a side view, partially cut away, of a bottle holder embodying the invention.

Referring to FIGS. 1 through 5, Wherein like reference numerals refer to like parts, there is illustrated a bottle holder 10. Bottle holder 10 includes a bottle engaging means 12 that is pivotally connected to a connector element 14. An attachment means 16 extends axially through the connector element 14.

Figure 3:
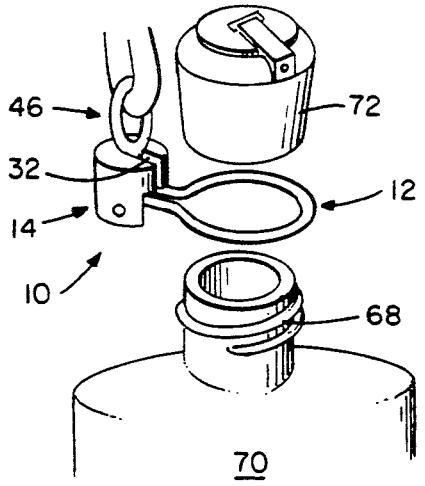
FIG. 3 is view of the bottle holder of the invention positioned for assembly between a bottle and a cap.

As shown best in FIG. 1, the bottle engaging means 12 has a substantially ring-shaped opened body 17 that terminates in a pair of legs 18 and 20. The legs 18 and 20 have a substantially L-shape. More particularly, the ends of legs 18 and 20 form a pair of prong means that are sized and shaped to pivotally interconnect the body 17 and connector element 14. As discussed further below, the legs 18 and 20 are locked in a pair of holes 28 of the connector 14 by the attachment means 16. The inner dimension of the body 17 is of sufficient size to permit easy positioning of the holder 10 on the neck portion 68 of a bottle 70 (FIG. 3). The outer dimension of the body 17, however, is such that the holder 10 will remain secured between the cap 72 and shoulder 74 of the bottle 70 during use. In the preferred embodiment of the invention, the bottle engaging means 12 has a substantially circular configuration so as to be useful in conjunction with bottles having screw caps.

Figure 2:
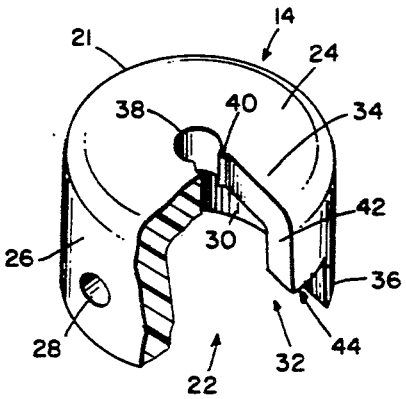
FIG. 2 is a perspective view, partially cut away, of the connector element of the bottle holder depicted in FIG. 1.

As shown in FIGS. 1 and 2, the connector element 14, is a hollow tubular cap 21 with an open end 22 and a closed end 24. A skirt or side 26 of the cap 21 includes oppositely disposed holes 28 which receive the legs 18 and 20 of the body 17. In an alternative embodiment, in order to accommodate smaller sized legs 18 and 20, an internal surface 30 of side 26 includes a pair of oppositely disposed indentations (not shown) rather than holes 28. Holes 28, or if used indentations, define an axis "X" about which the bottle engaging means 12 pivots as described below. The connector element 14 is manufactured from plastic or aluminum.

As shown best in FIG. 2, the closed end 24 and side 26 include an L-shaped slot 32. The slot 32 is defined by walls 42 and has a narrow first portion 34 extending radially through the closed end 24 and side 26 and an enlarged second portion 36 extending radially through the side 26. Slot 32 terminates in a centrally disposed aperture 38 in the closed end of the cap 21. The first portion 34 has a width sufficient to accommodate the attachment means 16 described in detail below. A pair of oppositely disposed retaining tips 40 are formed in the walls 42 of slot 32 adjacent the intersection of aperture 38 and slot 32. More particularly, tips 40 are positioned along a plane defined by the intersection of the wall of the central aperture 38 and wall 42. In operation, the tips 40 help secure the attachment means 16 in position within the aperture 38.

The first portion 34 of the slot 32 has a width that is substantially identical to the attachment means 16. At a point which is approximately one half the distance from the closed end 24 to the open end 22 of the cap 21, there is a jog 44 which defines the intersection with the second portion 36. Second portion 36 has a size sufficient to permit the legs 18 and 20 of the body 17 to be inserted into the interior of the connector element 14 for placement into holes 28. When configured as shown in FIG. 2, the slot 32 limits the pivotal movement of the bottle engaging means 12. More particularly, the slot 32 limits the upward movement of the bottle engaging means 12 to a position that is substantially perpendicular to a longitudinal axis of the connector element 14.

The attachment means 16 is manufactured from a durable material and includes a head portion 46 and a foot portion 48 joined by a neck 50. The neck portion 50 has a diameter substantially equal to the width of the slot 32 and has a minimum length equal to the thickness of the connector element 14. When the holder is fully assembled, the neck 50 is positioned within the aperture 38 so as to be freely rotatable about axis denoted "Y" in FIG. 1. Axis "Y" is perpendicular to the axis "X" discussed in connection with the connector element 14.

Figure 5:
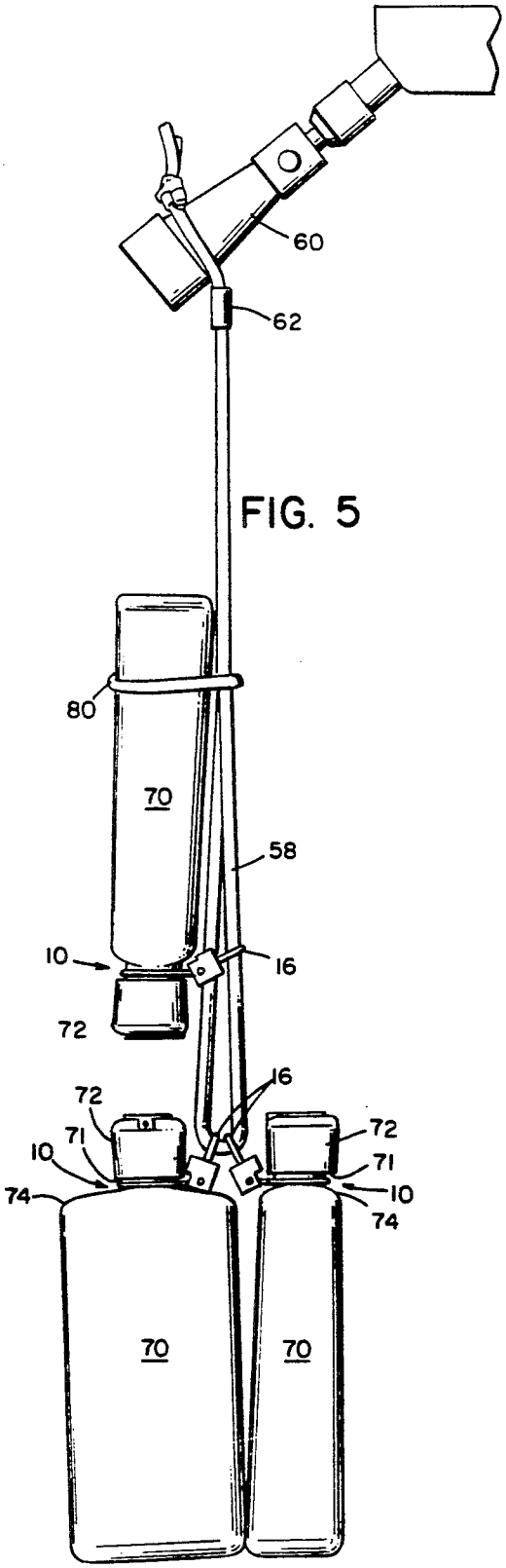
FIG. 5 is a perspective view of a bottle holding system embodying the invention in which two bottles are held in an upright position and a third bottle is held in an inverted position.
Figure 4:
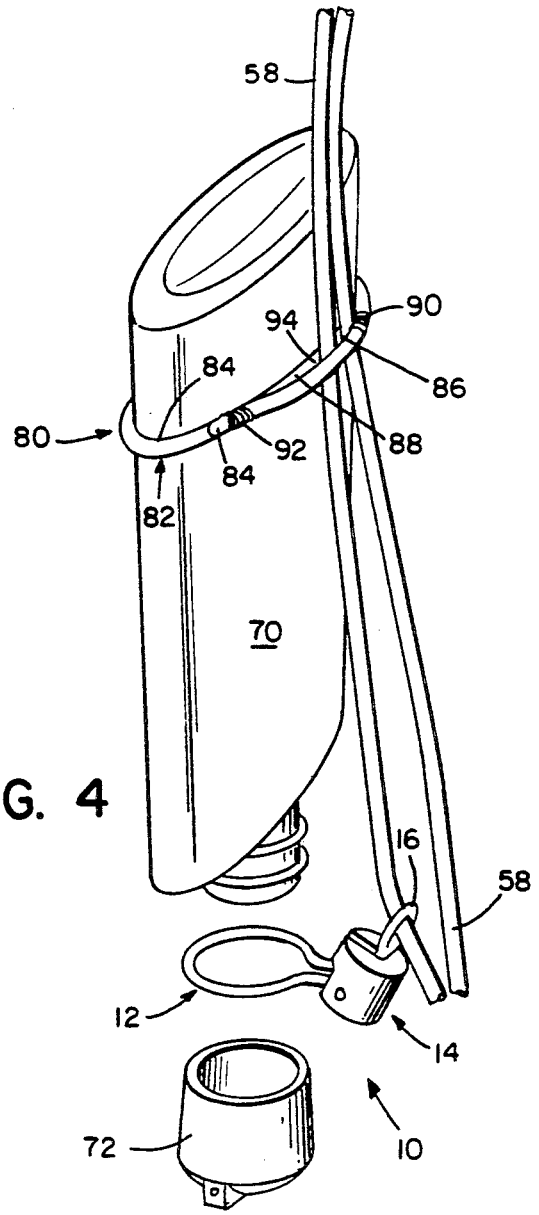
FIG. 4 is a perspective view of a bottle holder embodying the invention and useful for suspending a bottle in an inverted position.

The head portion 46 of the attachment means 16 is a ring-like member having an aperture 52 which receives a hanging cord 58 (FIGS. 4 and 5). Although the head portion 46 of the invention as depicted in FIGS. 1 through 5 has a substantially circular configuration, those skilled-in-the-art will appreciate that this component can have virtually any configuration provided it remains capable of supplying the necessary mechanical support for suspending a bottle 70 to which the holder 10 may be connected.

The foot portion 48 includes a flange 54 and a projection 56. The flange 54 is connected to the neck 50 and is disk-shaped. The flange 54 has a diameter larger than the diameter of the aperture 38 and, of course, smaller than the inner diameter of the connector element 14. The projection 56 extends axially away from the lower face of the flange 54. The projection 56 is sized such that it will extend between the inner surfaces of the legs 18 and 20 of the bottle engaging means 12. In operation, the projection 56 functions to keep the legs 18 and 20 spread apart and secured in holes 28. Thus, projection 56 prevents unwanted disengagement of the bottle engaging means 12 and connector element 14. Accordingly, in order to disengage the engaging means 12 and connector element 14, it is first necessary to remove attachment means 16.

The holder 10 is assembled by first squeezing the legs 18 and 20 of the bottle engaging means 12 together and then inserting them into the holes 28 of the connector element 14. Preferably, bottle engaging means 12 is composed of a material which is sufficiently resilient so that when legs !8 and 20 are released they will be retained in the holes 28. In the preferred embodiment of the invention, the bottle engaging means 12 is composed of plastic. Next, the neck 50 of the attachment means 16 is placed in the slot 32 and slid along its length until the neck 50 snaps into aperture 38. The projecting tips 40 maintain the attachment means 16 locked in position in the aperture 38.

Once assembled the holder 10 is attached to a bottle 70 in accordance with the assembly procedure depicted in FIG. 3. More particularly, a cap 72 is first removed from a bottle 70. Next, the holder 10 is placed on the neck 68 of the bottle 70. The cap 72 is then screwed back onto the bottle 70. Assembly is complete when the holder 10 is secured in position on the bottle 70 between a lower edge 71 of the cap 72 and a shoulder 74 of the bottle 70. It is preferred that there is sufficient room between the shoulder 74 of the bottle 70 and cap 72 so that holder 10 is freely rotatable relative to the bottle 70. Having secured the holder 10 to a bottle 70, a cord or rope 58 can be threaded through the aperture 52 in the attachment means 16 so as to suspend the bottle in either an upright or an inverted position as shown in FIGS. 4 and 5.

Referring now to FIG. 4, there is shown a bottle 70 that is mounted in an inverted position, using a holder 10 of the type described above in conjunction with a cord means 80 for maintaining the bottle in an inverted position. In the embodiment of the invention shown in FIG. 5, cord means 80 is a cord 82 having a main body 84 with ends 86 and 88. In the preferred embodiment, rope 58 and cord 82 are composed of a braided material. End 86 is attached to main body 84 adjacent end 88 by means of a clip 90 and end 88 is attached to main body 84 adjacent end 86 by means of a clip 92. A loop 94 is formed between the joined ends 86 and 88 of cord 82. It is to be understood that the ends of cord 82 can be attached by means other than a clip, for example, by use of a suitable adhesive or stitching. In operation, the holder 10 is first connected to a bottle 70 and then mounted on a suspending means 58, for example a rope, via its attachment means 16. In this case, connector element 14 is rotated 180° relative to the position shown in FIG. 3 so that bottle 70 is held in a substantially vertical position. That is, the enlarged portion 36 of connector element 14 is adjacent the body of the bottle when the bottle is to be held in an upright position and the enlarged portion 36 of connector 14 is adjacent the cap of the bottle when the bottle is to be held in an inverted position. Next, the bottle 70 is inverted. In the final step, the cord means 80 is threaded through loop 94 and slipped over the body of the bottle 70 so as to hold the bottle in an inverted position. Once assembled, the rope 58 can be affixed to a projection, such as a shower head, in the manner discussed with regard to FIG. 5 below.

Referring now to FIG. 5, there is shown a holding system which utilizes three holders 10 for holding three bottles, two of which are held in an upright position and a third is held in an inverted position. The holders 10 are all connected using a rope 58 which extends though each of the attachment means 16. Once the holders 10 are tied together, the rope 58 can be affixed to a projection such as a shower head 60. A slider 62 can be used to tighten the cord 58 about the nozzle of shower head 60.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A holder for suspending a bottle having a shoulder, a neck, and a bottle cap, said holder comprising:

(a) a bottle engaging means having a ring-shaped body that terminates in a pair of legs, said body sized to fit over the neck of a bottle and held thereon between a shoulder of the bottle and a bottle cap secured to the neck;

(b) a connector means in the form of a cap having a closed end, a depending skirt, and an open end, a means in the form of a oppositely disposed holes formed in said skirt, each said hole sized and shaped to receive one of said legs, a central aperture formed in said closed end, a slot formed in said skirt and said closed end, said slot terminating at said aperture; and (c) an attachment means having a head, a neck, and a foot, said neck joining said head and said foot, said neck sized to be received in said slot, said foot having a flange and a projection, said flange at the junction of said neck and said foot, said projection extending axially from said flange and away from said neck, said flange being larger than said slot, said projection sized to hold said legs in said holes, said head being freely rotatable relative to said connector means about a longitudinal axis of said holder, said bottle engaging means constrained for limited pivotal movement relative to said connector means about a transverse axis of said holder.

2. The holder of claim 1 wherein said bottle engaging means has a shape substantially congruent to said neck of said bottle.

3. The holder of claim 1 wherein said legs of said bottle engaging means each have an end, said ends forming a pair of prong means for engaging said holes formed in said connector means.

4. The holder of claim 1 wherein said head of said attachment means defines a suspending means.

5. The holder of claim 4 wherein said head of said suspending means is configured to receive a cord means for suspending said holder from a projection.

6. The holder of claim 5 wherein said head of said attachment means has a substantially circular configuration.

7. The holder of claim 1 including retaining means formed in said closed end of said connector means adjacent said central aperture for retaining said neck in said central aperture.

8. A holder for suspending a bottle having a shoulder, a neck, and a bottle cap, said holder comprising:

(a) a bottle engaging means having a ring-shaped body that terminates in a pair of legs, said body sized to fit over the neck of a bottle and held thereon between a shoulder of the bottle and a bottle cap secured to the neck;

(b) a connector means in the form of a cap having a closed end, a depending skirt, and an open end, a means in the form of a oppositely disposed holes formed in said skirt, each said hole sized and shaped to receive one of said legs, a central aperture formed in said closed end, a slot formed in said skirt and said closed end, said slot terminating at said aperture;

(c) an attachment means having a head, a neck, and a foot, said neck joining said head and said foot, said neck sized to be received in said slot, said foot having a flange and a projection, said flange at the junction of said neck and said foot, said projection extending axially from said flange and away from said neck, said flange being larger than said slot, said projection sized to hold said legs in said holes, said head having a centrally positioned aperture and being freely rotatable relative to said connector means about a longitudinal axis of said holder, said bottle engaging means constrained for limited pivotal movement relative to said connector means about a transverse axis of said holder; and (d) a suspending means passing through said aperture in said head of said attachment means, said suspending means providing a means for suspending the bottle from a projection.

9. The holder of claim 8 wherein said bottle engaging means has a shape substantially congruent to said neck of said bottle.

10. The holder of claim 8 wherein said legs of bottle engaging means each has an end, said ends forming a pair of prong means for engaging said holes formed in said connector means.

11. The holder of claim 8 including retaining means formed in said closed end of said connector means adjacent said central aperture for retaining said neck in said central aperture.

12. A holder for suspending at least two bottles, each bottle having a shoulder, a neck, and a bottle cap, said holder comprising:

(a) at least two bottle engaging means, each said bottle engaging means having a ring-shaped body that terminates in a pair of legs, said body sized to fit over the neck of a bottle and held thereon between a shoulder of the bottle and a bottle cap secured to the neck;

(b) a connector means for each said bottle engaging means, each said connector means including a cap having a closed end, a depending skirt, and an open end, a pair of oppositely disposed holes formed in said skirt, each said hole sized and shaped to receive one of said legs, a central aperture formed in said closed end, a slot formed in said skirt and said closed end, said slot terminating at said aperture, and a retaining means formed in said closed end adjacent said central aperture;

(c) an attachment means for each said connector means, each said attachment means having a head, a neck, and a foot, said neck joining said head and said foot, said neck sized to be received in said slot, said foot having a flange and a projection, said flange at the junction of said neck and said foot, said projection extending axially from said flange and away from said neck, said flange being larger than said slot, said projection sized to hold said legs in said holes, said head having a centrally positioned aperture and being freely rotatable relative to said connector means about a longitudinal axis of said holder, said bottle engaging means constrained for limited pivotal movement relative to said connector means about a transverse axis of said holder, said retaining means retaining said neck in said central aperture; and (d) a suspending means passing through said apertures in each said head of each said attachment means, said suspending means providing a means for suspending the bottle from a projection.

13. The holder of claim 12 wherein each said bottle engaging means has a shape substantially congruent to said neck of said bottle.

14. The holder of claim 13 wherein said legs of each said bottle engaging means each has an end, said ends forming a pair of prong means for engaging said holes formed in said connector means.

15. The holder as claimed in claim 12 including cord means configured to be attached to one of the bottles and said suspending means and wherein one of said bottle engaging means is mounted in a first orientation relative to the bottle cap of one of the bottles and the other of said bottle engaging means is mounted in a second orientation relative to the other bottle cap of the other bottle, said first orientation and said second orientation being 180° apart, the one bottle having said cord means being suspended in an inverted position and the other bottle being suspended in an upright position.

16. The holder claim 15 wherein said suspending means and said cord means are manufactured from a braided material.

* * * * *